US009651226B2

(12) United States Patent
Badley et al.

(10) Patent No.: US 9,651,226 B2
(45) Date of Patent: May 16, 2017

(54) HINGED MOUNT FOR A LUMINAIRE

(71) Applicant: Cooper Technologies Company, Houston, TX (US)

(72) Inventors: Caleb Timothy Badley, Sharpsburg, GA (US); Philip Dean Winters, Senoia, GA (US); Timothy Glen Wright, Peachtree City, GA (US); Reed Alan Bradford, Peachtree City, GA (US); Kenneth Hayes, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/186,648

(22) Filed: Jun. 20, 2016

(65) Prior Publication Data

US 2016/0290612 A1 Oct. 6, 2016

Related U.S. Application Data

(62) Division of application No. 13/826,197, filed on Mar. 14, 2013, now Pat. No. 9,464,790.

(60) Provisional application No. 61/644,226, filed on May 8, 2012, provisional application No. 61/677,777, filed on Jul. 31, 2012.

(51) Int. Cl.

| | |
|---|---|
| ***F21V 21/14*** | (2006.01) |
| ***F21V 15/01*** | (2006.01) |
| ***F21V 17/02*** | (2006.01) |
| ***F21V 17/10*** | (2006.01) |
| ***F21V 19/00*** | (2006.01) |
| ***F21S 8/04*** | (2006.01) |
| ***F21V 21/30*** | (2006.01) |
| ***F21V 29/76*** | (2015.01) |
| ***F21V 23/00*** | (2015.01) |
| *F21V 17/18* | (2006.01) |
| *F21Y 101/00* | (2016.01) |

(52) U.S. Cl.

CPC ..... *F21V 19/00* (2013.01); *F21S 8/043* (2013.01); *F21V 15/01* (2013.01); *F21V 17/02* (2013.01); *F21V 17/10* (2013.01); *F21V 21/14* (2013.01); *F21V 21/30* (2013.01); *F21V 23/002* (2013.01); *F21V 23/005* (2013.01); *F21V 29/76* (2015.01); *F21V 17/18* (2013.01); *F21Y 2101/00* (2013.01)

(58) Field of Classification Search

CPC ..... F21V 17/14; F21V 17/107; F21V 21/00; F21V 21/02; F21V 21/30; F21V 17/18

See application file for complete search history.

(56) References Cited

U.S. PATENT DOCUMENTS 3,560,731 A * 2/1971 Burton ..... F21S 8/088 292/147

3,840,735 A * 10/1974 Chan ..... F21V 15/005 362/267

(Continued)

*Primary Examiner* — Andrew Coughlin
*Assistant Examiner* — Colin Cattanach
(74) *Attorney, Agent, or Firm* — King & Spalding LLP

(57) ABSTRACT

Present embodiments provide a light fixture having rotatable light modules and an extendable hinged mounting assembly. The light modules are electrically coupled to the light fixture via a cord and a grommet/bracket feature which provides strain relief and a waterproof barrier. The extendable hinged mounting assembly allows the light fixture to be mounted onto a ceiling or other structure while providing a mounted position and an install position.

16 Claims, 17 Drawing Sheets

(56) References Cited

U.S. PATENT DOCUMENTS 3,895,227 A * 7/1975 Murray ..... F21V 23/026 362/264
4,039,820 A * 8/1977 Materese ..... F21V 17/14 362/223
4,177,504 A * 12/1979 Henderson, Jr. ..... F21V 17/02 362/282
4,985,810 A 1/1991 Ramsey
5,465,199 A * 11/1995 Bray ..... F21S 8/02 362/147
6,264,348 B1 * 7/2001 Ellis ..... F21S 8/04 362/223
6,293,510 B1 * 9/2001 Bradford ..... F21V 17/107 248/317
6,450,668 B1 * 9/2002 Kotloff ..... F21S 8/06 362/221
6,517,216 B1 2/2003 Cercone et al.
7,131,753 B1 11/2006 Edwards, Jr.
7,686,483 B1 3/2010 Aubrey
7,806,713 B1 10/2010 Harris
7,874,708 B1 * 1/2011 Jones ..... F21V 21/048 248/220.22
8,066,407 B2 11/2011 Remus et al.
8,167,468 B1 5/2012 Olsson et al.
8,491,157 B2 7/2013 Oba et al.
8,523,409 B1 9/2013 Drake et al.
8,828,153 B2 9/2014 Haga et al.
8,876,333 B1 11/2014 Rashidi
2009/0267525 A1 10/2009 Zheng et al.
2009/0321598 A1 * 12/2009 Vann ..... F21V 21/00 248/227.1
2010/0014289 A1 1/2010 Thomas et al.
2010/0220488 A1 9/2010 Zheng
2012/0026744 A1 * 2/2012 Peter ..... F21V 21/02 362/370
2012/0086340 A1 4/2012 Hashizume

* cited by examiner

HINGED MOUNT FOR A LUMINAIRE

RELATED APPLICATION

The present application is a divisional application of and claims priority to U.S. Non-Provisional patent application Ser. No. 13/826,197 filed on Mar. 14, 2013; which claims priority to U.S. Provisional Patent Application No. 61/644,226 titled "Systems, Methods, and Devices for Providing Rotatable Light Modules in a Luminaire", filed May 8, 2012; and U.S. Provisional Patent Application No. 61/677,777 titled "Snap and Lock Hinge Mount", filed Jul. 31, 2012. The entire contents of each of the foregoing applications are hereby incorporated herein by reference.

TECHNICAL FIELD

Embodiments of the present disclosure relate generally to lighting solutions, and more particularly to systems, methods, and devices for providing a hinged mounting solution in a luminaire for quick installation.

BACKGROUND

Previous designs of light fixtures that incorporate rotatable LED-based light modules often include wiring layouts that are internal to the light fixture housing. This often limits the range of movement of the light modules and wiring integrity of the light fixture. For example, an operator changing the angle of the light modules may have to be extra careful when handling the light fixture so as not to accidentally pull or otherwise disrupt the wiring between the light modules and the other electronic components of the light fixture. Furthermore, such light fixtures are often mounted on a ceiling or other mounting structure, through which the light fixture is also electrically wired. During installation or maintenance, the light fixture may need to be removed from the ceiling in order to access the wires or other installation interface on the back side of the light fixture. In such cases, the operator may need to support the light fixture while performing the operation, making the process more challenging and error prone. Thus, what is needed is a light fixture that allows for wiring the rotatable modules in such a way as to allow for rotation of the module while reducing the size or necessary layout of a fixture housing yet maintain wiring integrity and electrical reliability for the rotatable module. Additionally, the light fixture should provide a mounting means that allows for easy accessibility of the light fixture.

SUMMARY

An example embodiment of the present disclosure includes a light fixture. The light fixture includes a central housing containing one or more electrical components, a central grommet, wherein the central grommet traverses a central opening in the central housing, providing a path for a central cord to enter the central housing through the grommet, wherein the central grommet forms a water tight seal between the central cord and the central housing, and wherein the central cord is electrically coupled to the one or more electrical components. The light fixture further includes at least one rotatable light module coupled to the central housing, the at least one rotatable light module comprising a heat sink on a heat sink side of the at least one rotatable light model, and at least one peripheral cord coupled to the at least one rotatable light module at a first end of the at least one peripheral cord and traversing at least one respective peripheral opening in the central housing, wherein the at least one peripheral cord is electrically coupled to the one or more electrical components and the rotatable light module.

Another example embodiment of the present disclosure includes a mounting assembly. The mounting assembly includes a top plate having a first mating mechanism, a support hanger having a first end and a second end, the first end rotatively coupled to the top plate. The mounting assembly also includes a bottom plate comprising a second mating mechanism corresponding to the first mating mechanism, wherein the second end of the support hanger is rotatively coupled to the bottom plate. The mounting assembly is foldable into a folded position and extendable into an extended position. In the folded position, the bottom plate, the support hanger, and the top plate are substantially parallel, and wherein the bottom plate is coupled to the top plate via the first and second mating mechanisms, the bottom plate being a first distance from the top plate. In the extended position, the first mating mechanism is decoupled from the second mating mechanism, the bottom plate being a second distance from the top plate, the second distance being greater than the first distance, and wherein the bottom plate is supported by the top plate via the support hanger.

Another example embodiment of the present disclosure includes a fixture mounting assembly. The fixture mounting assembly includes a top plate having a first mating mechanism, a support hanger having a first end and a second end, the first end moveably coupled to the top plate, and a fixture housing comprising a second mating mechanism on a top surface of the fixture housing corresponding to the first mating mechanism, wherein the second end of the support hanger is coupled to the fixture housing. The mounting assembly is foldable into a folded position and extendable into an extended position. In the folded position, the fixture housing is coupled to the top plate via the first and second mating mechanisms, the fixture housing being a first distance from the top plate. In the extended position, the first mating mechanism is decoupled from the second mating mechanism, the fixture housing being a second distance from the top plate, the second distance being greater than the first distance, and wherein the fixture housing is supported by the top plate via the support hanger.

BRIEF DESCRIPTION OF THE DRAWINGS

The foregoing and other features and aspects of the disclosure are best understood with reference to the following description of certain example embodiments, when read in conjunction with the accompanying drawings, wherein.

BRIEF DESCRIPTION OF EXAMPLE EMBODIMENTS

Embodiments of the disclosure are directed to the construction and assembly of a light fixture with rotatable light modules and hinged mounting assembly. Example embodiments of the disclosure include flexible cords accessible on the outside of the light fixture housing to act as a strain relief to prevent internal wiring damage due to pulling of the flexible cord. The systems and methods described herein may provide several advantages including providing a strain relief to prevent the flexible cord from being pulled out of the light module (such as an LED-based light module) during transport, installation, or in the event the fixture was disturbed or vandalized. The embodiments of the disclosure described herein include other benefits such as providing a water tight flexible cord and grommet assembly to prevent water from entering the light module between the flexible cord and an overmolded grommet. Another benefit of certain embodiments of the disclosure is that when the light module is rotated, the integrity of the flexible cord entry into the back of the light module (or the heat sink of the light module) remains uncompromised. Embodiments described herein also include a snap and lock hinge mount for securing the light fixture to a ceiling or wall while allowing for easy access and installation.

Example embodiments of the disclosure now will be described more fully hereinafter with reference to the accompanying drawings, in which example embodiments of the disclosure are shown. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like, but not necessarily the same or identical, elements throughout.

Figure 1A:
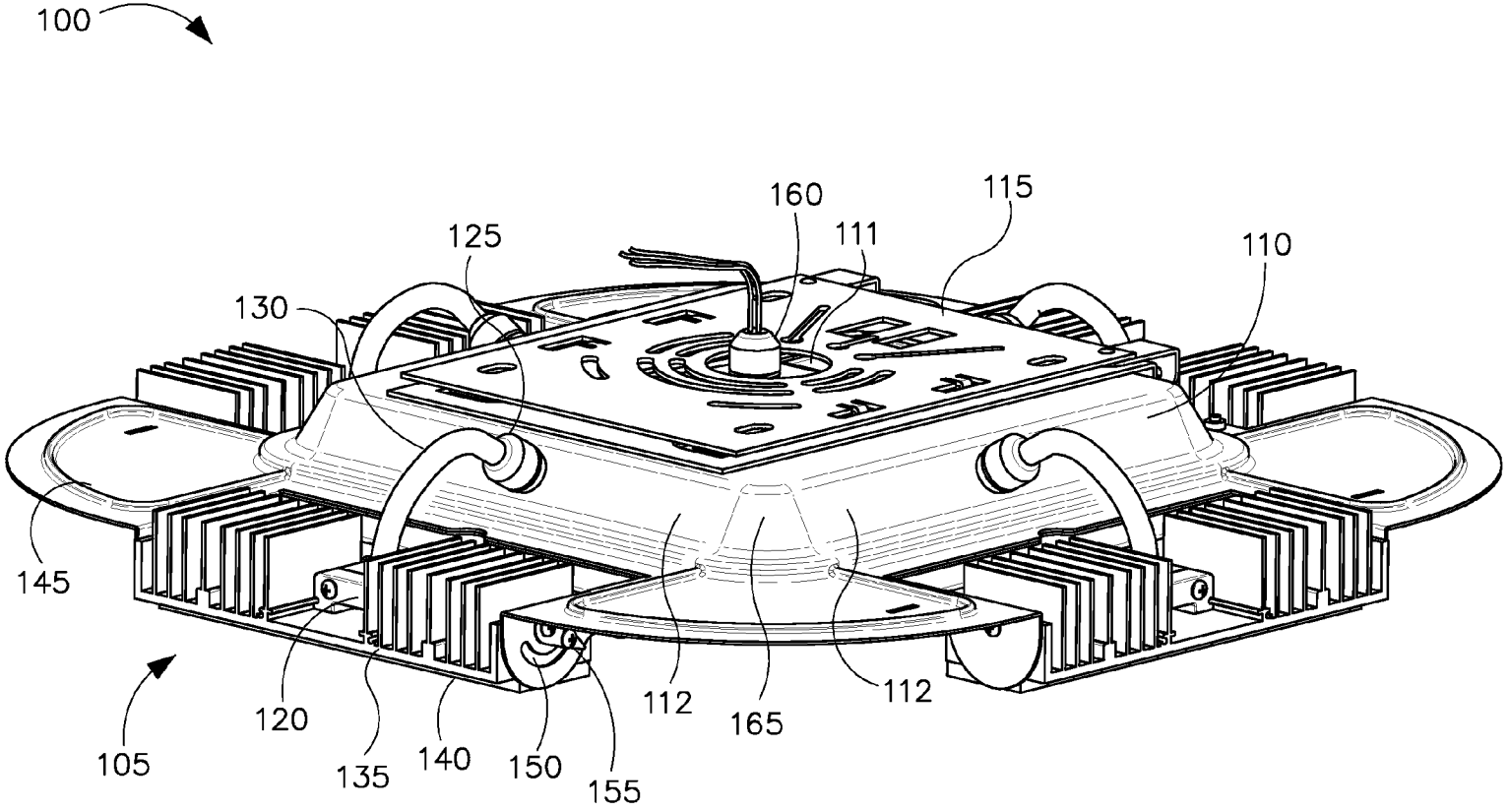
FIG. 1A is a light fixture having rotatable light modules and a hinged mount in accordance with an example embodiment of the disclosure.

FIG. 1A is a light fixture 100 having rotatable light modules 105 and a snap and lock hinge mount 115 in accordance with an example embodiment of the disclosure. As shown in FIG. 1A, the light fixture 100 includes a central housing 110. The central housing 110 may house internal components of the light fixture, such as a driver module, backup battery, sensor(s), controller(s), wiring splices or junctions, etc. The main power line wiring 160 enters the central housing 110 in the middle of a top surface 111 of the central housing 110. As shown in FIG. 1A, the top surface 111 of the central housing 110 has a mounting assembly 115 attached. In the example embodiment shown in FIG. 1A, a grommet 125 and a cord 130 are located in the middle of each side 112 of an upper portion 165 of the central housing 110. The grommet 125 and cord 130 shield electrical conductors (e.g. wire, etc.) being routed from the central housing 110 to the light modules 105. In other embodiments of the disclosure, the grommet 125 and cord 130 may be located elsewhere along the exterior of the central housing 110 (i.e. other than the middle of each side of the central housing). Each cord 130 attaches to the light module 105, which in the embodiment shown in FIG. 1A, occurs in the middle of the light module 105 and is supported by a bracket assembly 120 and another grommet (not shown). In other embodiments of the disclosure, the cord 130 may be connected to the light module 105 elsewhere along the heat sink 135 or other surface of the light module 105 (i.e. other than the middle of the back of the heat sink 135 of the light module 105).

The light fixture 100 further includes one or more thin corner sections 105 extending from corners of the central housing 110. The light modules 105 are disposed between the thing corner sections 155 at the sides 112 of the light fixture. In certain example embodiments, and as illustrated in FIG. 1A, the light module 105 is attached to the thin corner sections 145 at one or more ends. The thin corner sections 145 include a slot 150 which defines a range of rotation for the light module 105. A pin (or screw or similar protrusion) 155 engages the slot 150 and the light module 105 to provide rotation for the light module 105 and hold (or lock) the light module 105 in place at a particular angle to direct light from the module 105 in a particular direction or configuration. The light module 105 includes a heat sink 135 and an LED board 140 (or substrate) thermally coupled to the heat sink 135.

Figure 1B:
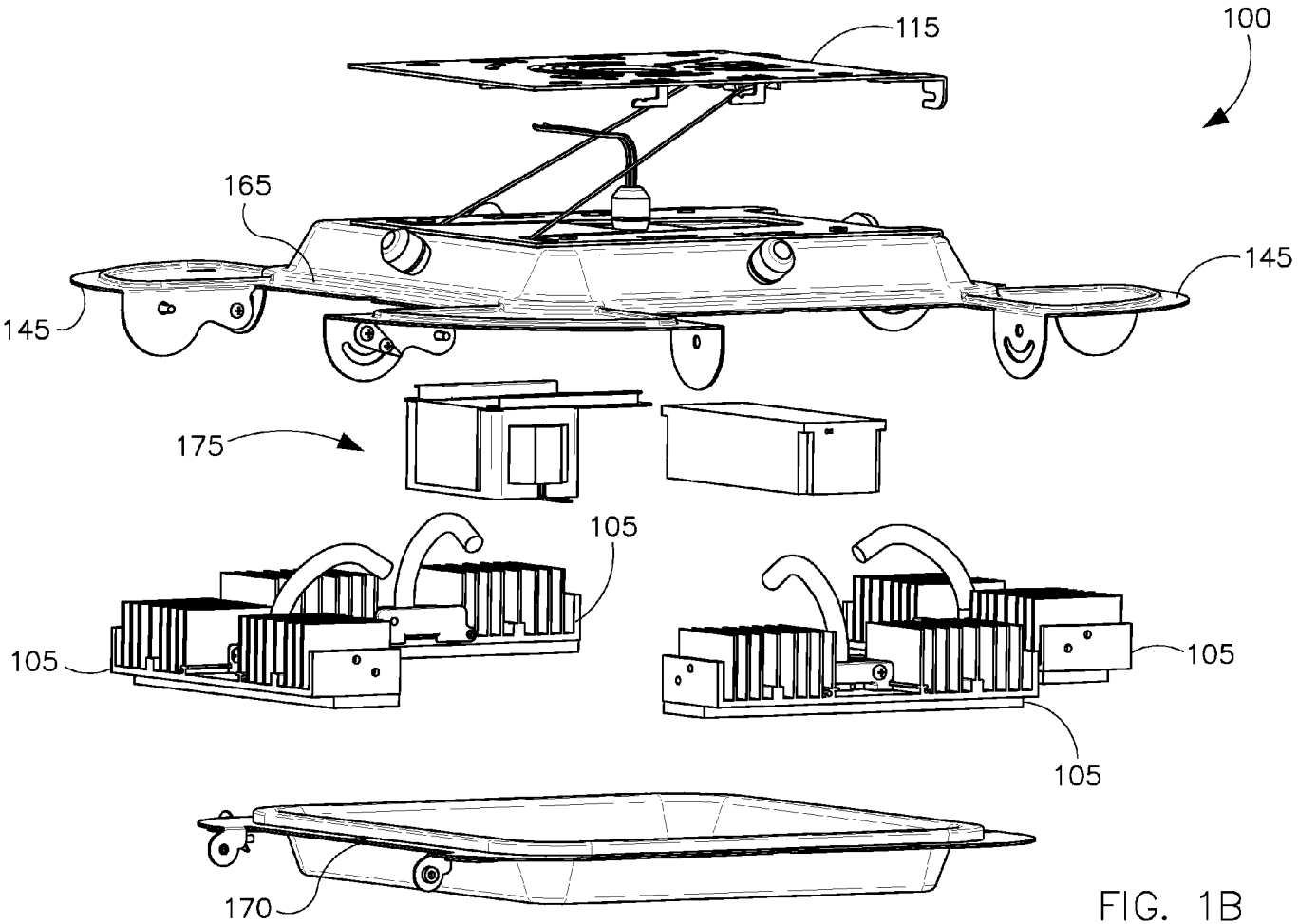
FIG. 1B is an exploded view of the light fixture of FIG. 1A in accordance with an example embodiment of the disclosure.

FIG. 1B is an exploded view of the light fixture of FIG. 1A in accordance with an example embodiment of the disclosure. As shown in FIG. 1B, the central housing 110 is made up of a top portion 165 and a bottom portion 170. The housing 110 encloses/houses one or more internal components 175 such as a driver, backup battery, etc. FIG. 1B also shows the mounting assembly 115 for suspending the fixture from a ceiling. FIG. 1B also provides a better view of the corner section 145 of the housing 110 and how the light module 105 connects to the housing 110 while allowing the module 105 to rotate. In the embodiment shown in FIG. 1B, the top and bottom portions 165, 170 along with the corner sections 145 of the light fixture 100 are made from a deep drawn process using cold rolled steel. Such material allows for an overall lower assembly and manufacturing cost, while maintaining considerable strength as compared to traditional materials used for light fixture housings (e.g. aluminum, die casting, etc.).

Figure 2:
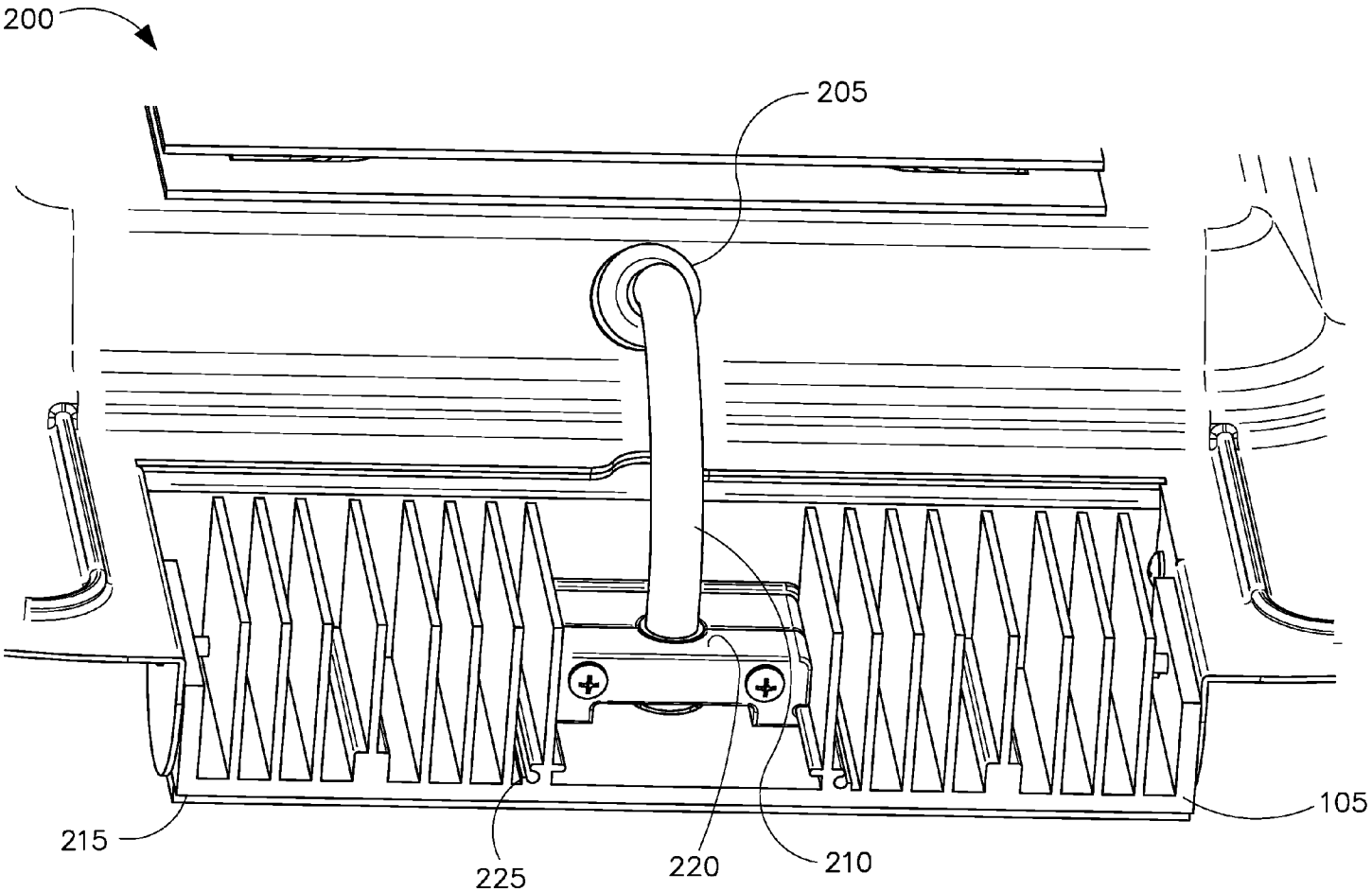
FIG. 2 shows a top view of a light module connection assembly in accordance with an example embodiment of the disclosure.

FIG. 2 shows a top view of a light module connection assembly 200 in accordance with an example embodiment of the disclosure. As shown in FIG. 2, the light module connection assembly 200 includes a grommet 205 covering an opening from the central housing 110 of the light fixture 100 which allows a cord 210 to pass through and connect to the back of the light module 105 for routing wiring to the LEDs on the LED board/substrate 215 of the light module 105 in such a way that the wiring is protected from water and prevents water from entering the fixture housing 110. The heat sink 225 located on the back of the light module 105 is shaped to accept the cord 210 as well as a bracket assembly 220 surrounding the cord 210. In the embodiment shown in FIG. 2, the bracket assembly 220 provides strain relief for the cord 210 when the cord is handled, pulled, or twisted. Further, the bracket assembly 220 protects the flexible cord 210 entry into the heat sink 225 while helping to prevent water entry into the light module 105. In an alternative embodiment of the disclosure, a grommet may be used on the light module 105 in place of (or in addition to) the bracket assembly 220 to provide similar protection and functionality (e.g. stain relief, etc.) as the bracket assembly 220. In certain example embodiments, the lighting module 105 includes light sources other than LEDs.

Figure 3:
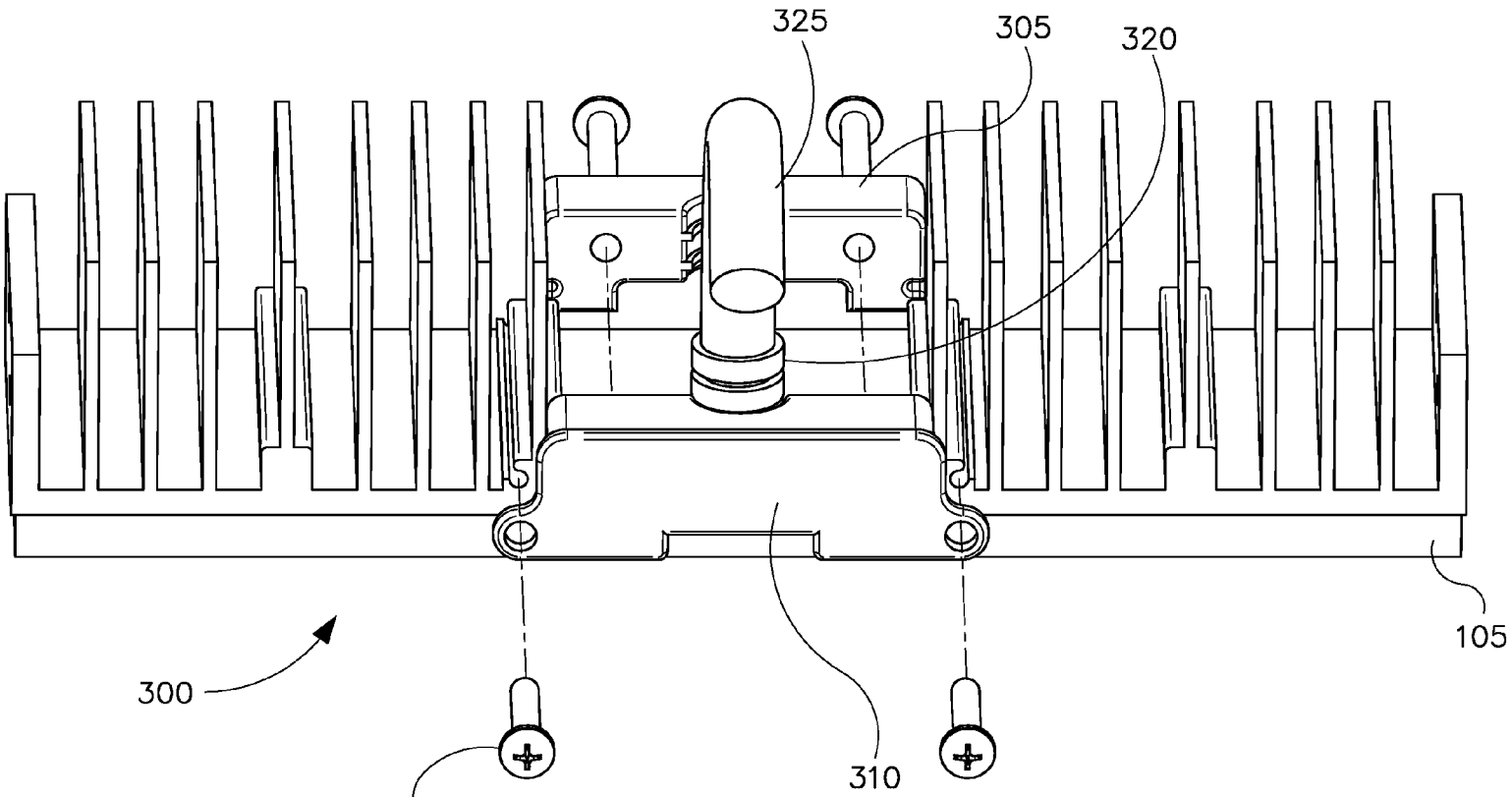
FIG. 3 is an exploded view of a bracket assembly used in a light module connection assembly in accordance with an example embodiment of the disclosure.

FIG. 3 is an exploded view of a bracket assembly 300 used in a light module connection assembly 200, in accordance with an example embodiment of the disclosure. As shown in FIG. 3, the bracket assembly 300 is made up of a first bracket 305 and second bracket 310, each of which has a C-shaped surface profile on one side, such that when the first bracket 305 and second bracket 310 are engaged with one or more fasteners 315 (e.g., a screw, pin, rivet, or other protrusion that may or may not be able to be tightened) the bracket assembly 300 compresses a grommet 320 around the flexible cord 325, making the connection where the flexible cord 325 attaches to the light module water tight. As shown in FIG. 3, an overmold grommet 320 covers the flexible cord 325 attaching to the light module 105.

Figure 4:
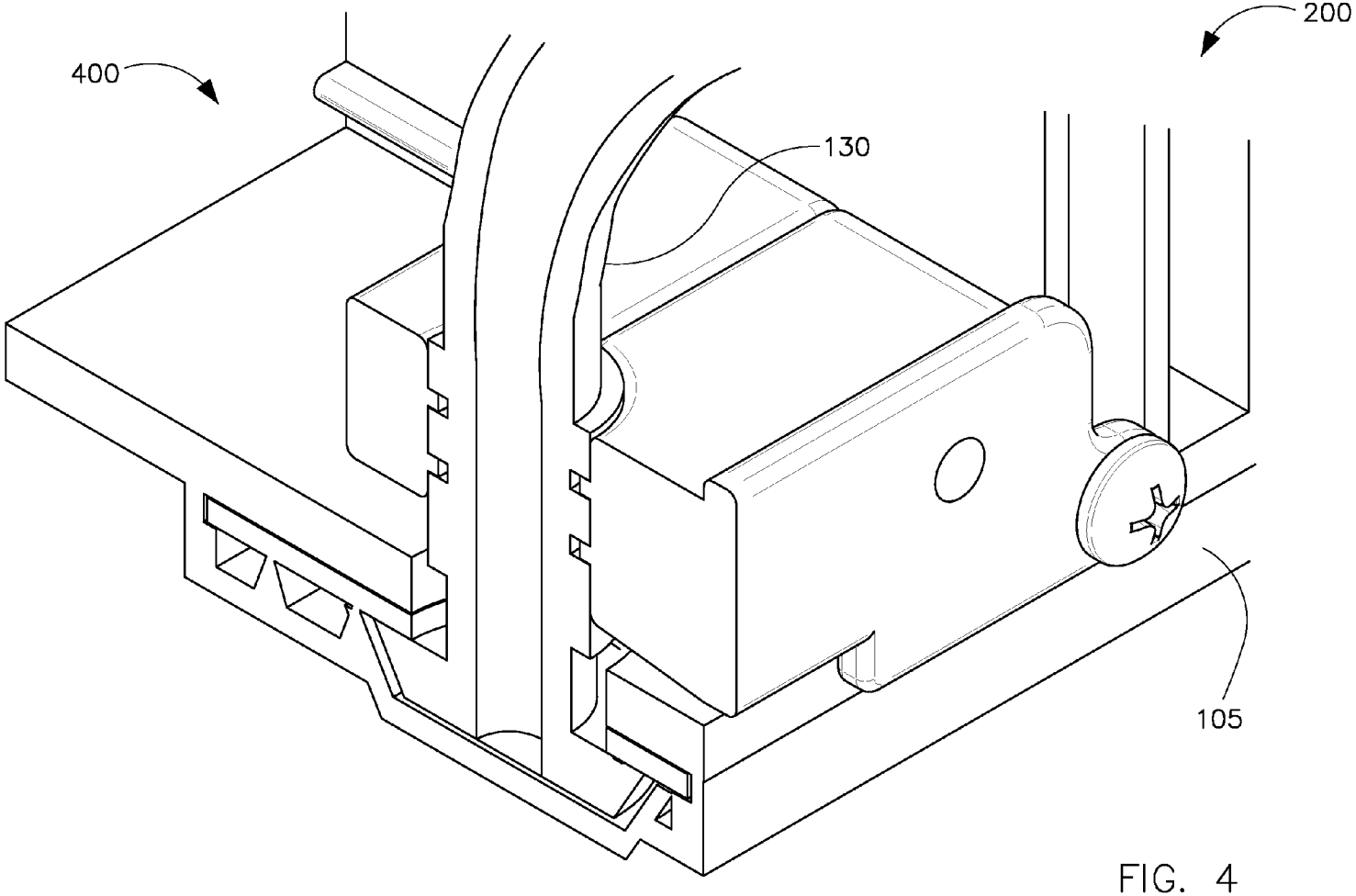
FIG. 4 is a cross-sectional view of a light module connection assembly in accordance with an example embodiment of the disclosure.
Figure 5:
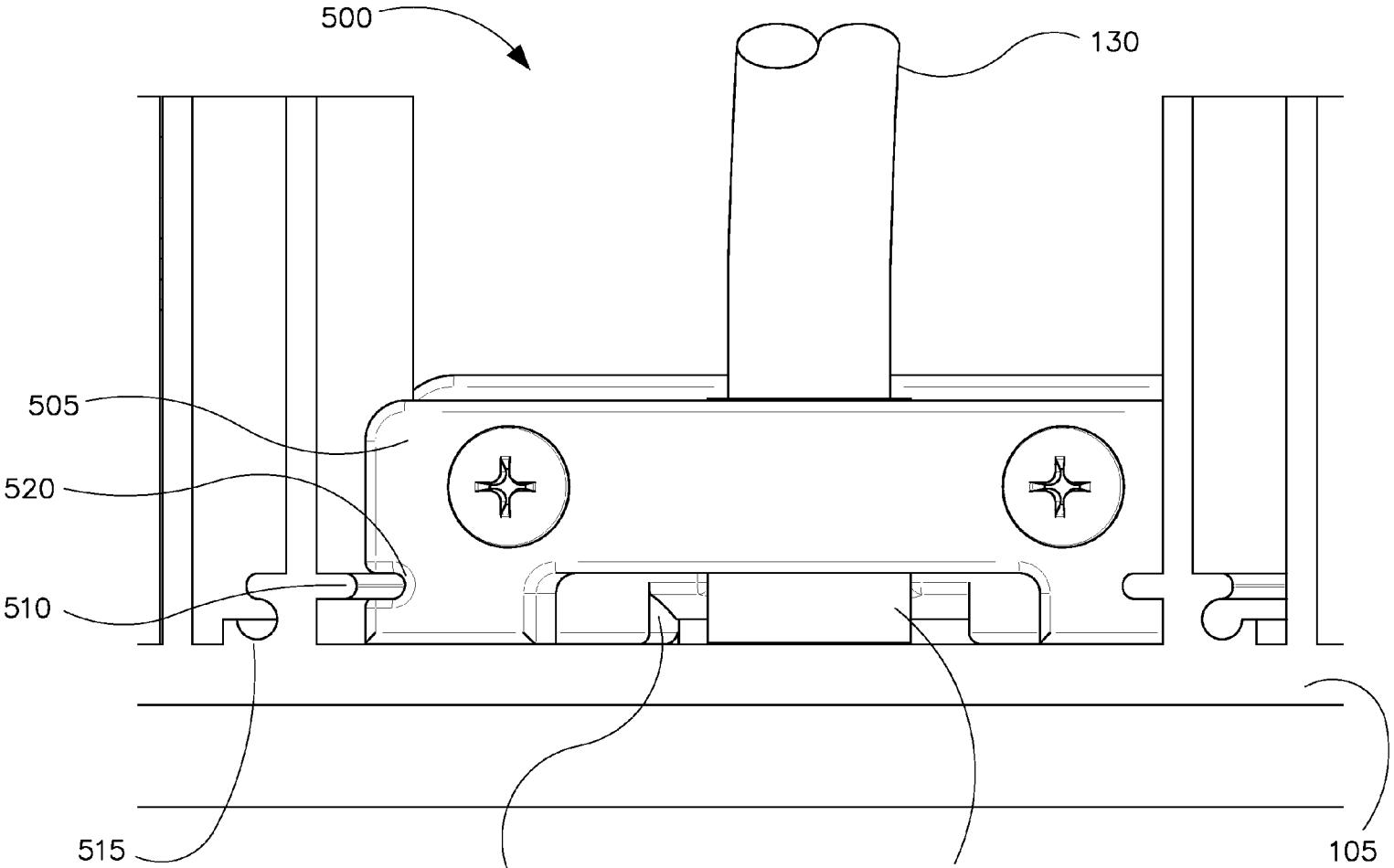
FIG. 5 shows a side view of a light module connection assembly in accordance with an example embodiment of the disclosure.

FIG. 4 is a cross-sectional view 400 of a light module connection assembly 200 in accordance with an example embodiment of the disclosure. As shown in FIG. 4, the cord 130 is held in place with respect to the light module 105 via the light module connection assembly 200. FIG. 5 shows a side view of a light module connection assembly 500 in accordance with an example embodiment of the disclosure. As shown in FIG. 5, the brackets 505 are shaped such that they engage with a corresponding feature 510 of the heat sink 515. In the example embodiment shown in FIG. 5, the brackets 505 have one or more slots 520 that accept a protrusion 510 that is integrated with the heat sink 515 to allow for better protection and support for the cord connection to the light module 105, particularly during rotation of the light module 105 and/or handling of the cord 130. In an alternative embodiment of the disclosure, the configuration between the brackets 505 and the heat sink feature 510 may be different (e.g., the heat sink 515 may contain a slot and the brackets 505 include corresponding protrusions, the brackets 505 and heat sink 515 may be sized for a snap fit relation, etc). Also shown in FIG. 5, is a recess 525 in the brackets surrounding the grommet 530 covering the cord 130 and light module connection, which provides clearance for the end of the grommet 530 while allowing the C-shaped surface of the brackets 515 to tightly surround the grommet 530 and/or cord 130.

Figure 6:
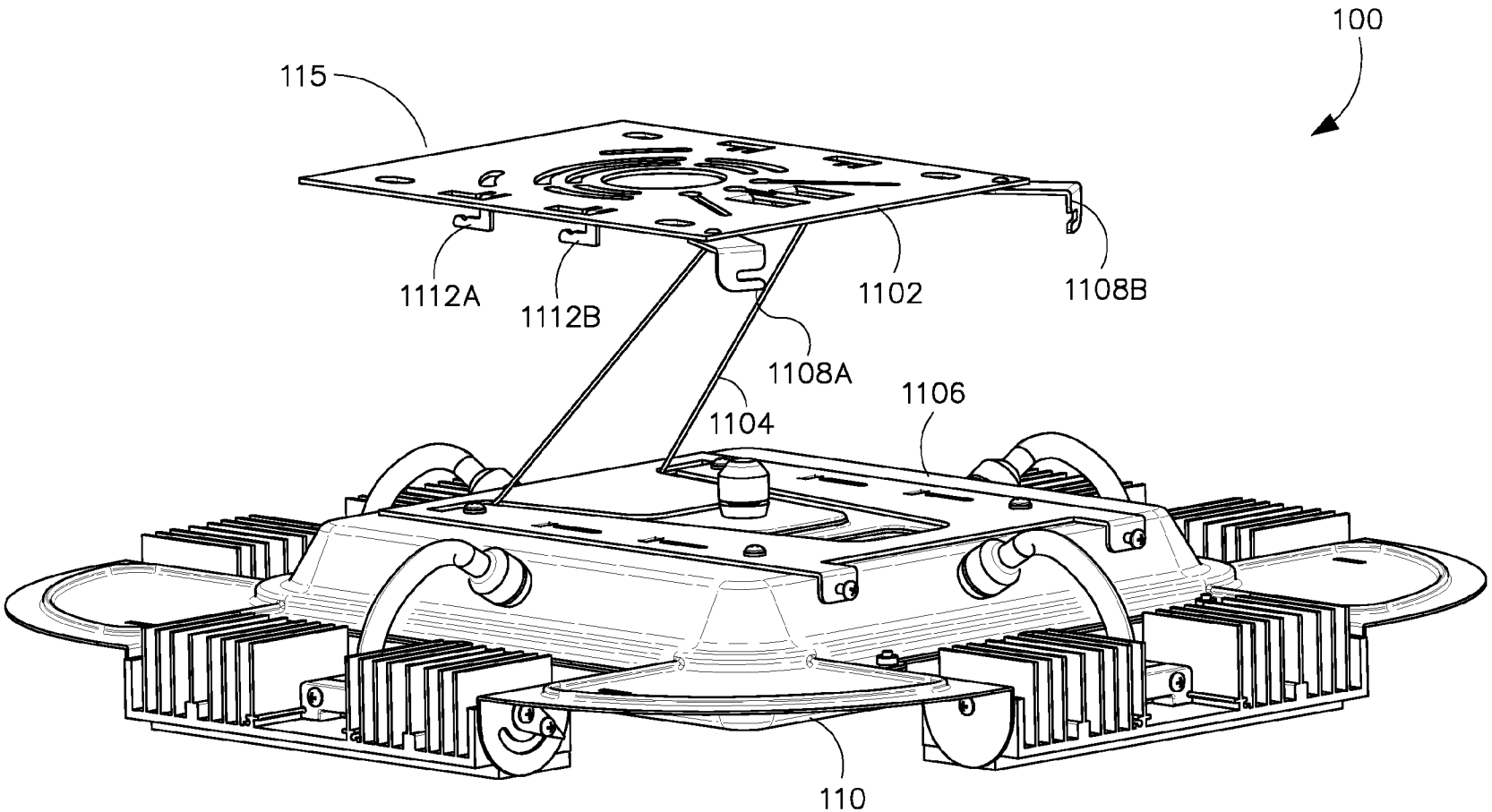
FIG. 6 is a perspective view of a light fixture and snap and lock hinge mount in an install position according to an example embodiment.

FIG. 6 is a perspective view of the light fixture 100 and snap and lock hinge mount 115 according to an example embodiment. The snap and lock hinge mount 115 includes a top plate 1102, a wire support hanger 1104, and a bottom plate 1106. The bottom plate 1106, in the embodiment illustrated in FIG. 6, is mounted to the light fixture housing 110. In various embodiments, the bottom plate 1106 may be mounted to the light fixture housing 110 using rivets, screws, plastic fasteners, adhesive, or any other suitable attachment means.

In certain exemplary embodiments, the snap and lock hinge mount 115 is movable between an install position and a mounted position. In the "install" position, the top plate 1102 may be mounted to an electrical wiring box or enclosure, for example, while the bottom plate 1106 (and the fixture housing 110) is supported in a hanging position by the wire support hanger 104 a distance apart from the top plate 1102. In this position, an electrician is able to make electrical wiring connections to connect power to the light fixture 100 without completely removing the light fixture 100. After the light fixture 100 is electrically coupled to power, the snap and lock hinge mount 115 may be moved and locked into a "mounted" position.

As illustrated in FIG. 6, the top plate 1102 includes a first snap foot 1112A and a second snap foot 1112B proximate to one side of the top plate 1102. The top plate 1102 also includes a first snap foot 112A and a second snap foot 1112B proximate to the other side of the top plate 1102. In certain embodiments, lock arms 1108A and 1108B are mounted to the top plate 1102 at a pivot point, as described in further detail below. It is noted that the number and position of the snap feet 1112 and the lock arms 1108 may vary among embodiments. In other words, the embodiment of the snap and lock hinge mount 115 illustrated in FIG. 6 is an example only.

Figure 7:
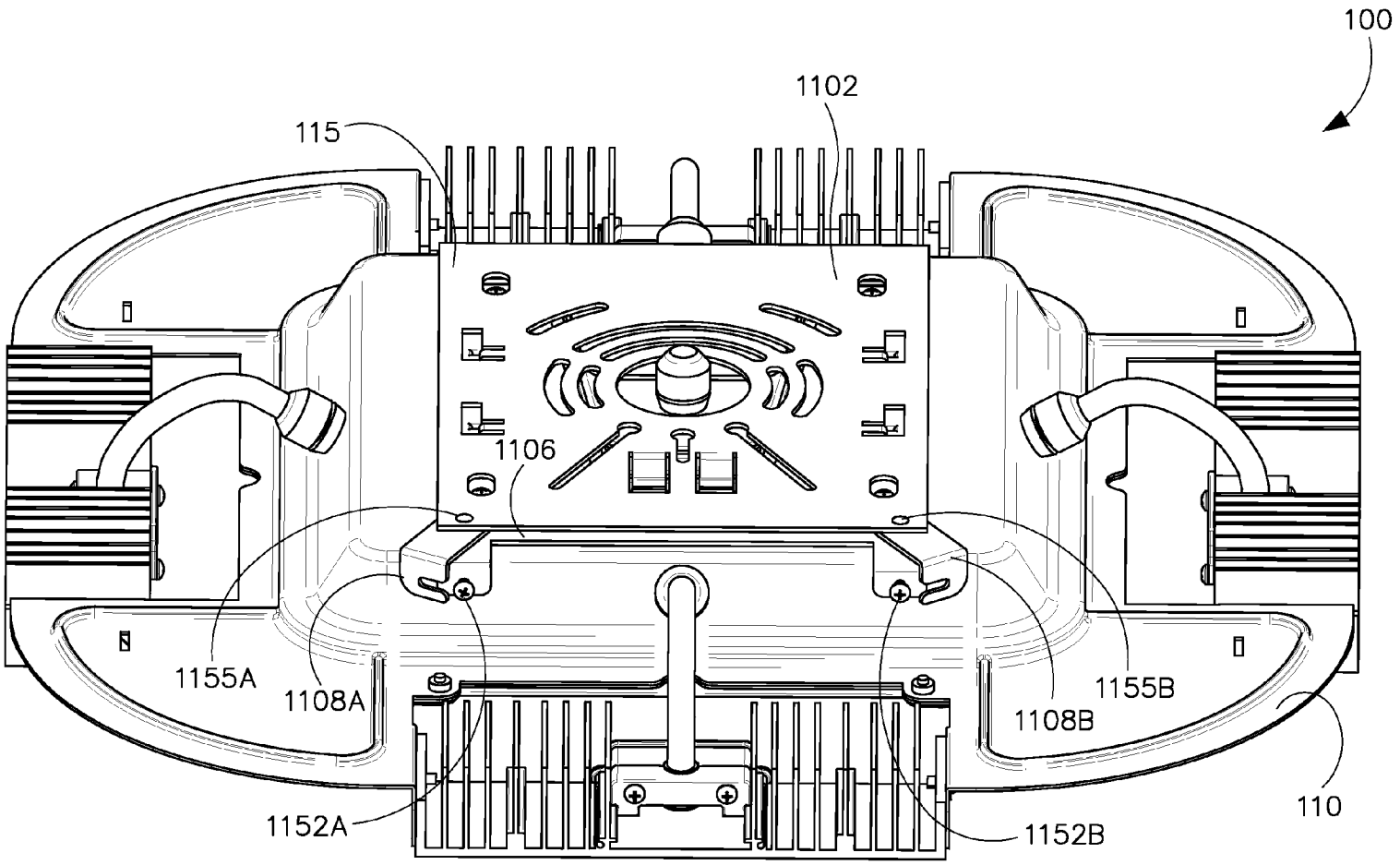
FIG. 7 is a perspective view of a light fixture and snap and lock hinge mount in a mounted position according to an example embodiment.

FIG. 7 is a perspective view of the light fixture 100 and the snap and lock hinge mount 115 in a mounted position. In FIG. 7, the top plate 1102 and the bottom plate 1106 have been brought together into contact or near-contact. Here, the lock arms 1108A and 1108B may be rotated into a locked position over the screws 1152A and 1152B. The lock arms 1108A and 1108B may be pivoted at pivot points 1155A and 1155B, respectively. In certain embodiments, the pivot points 1155A and 1155B may secure the lock arms 1108A and 1108B, respectively, by rivets or other suitable fastening means.

Figure 8:
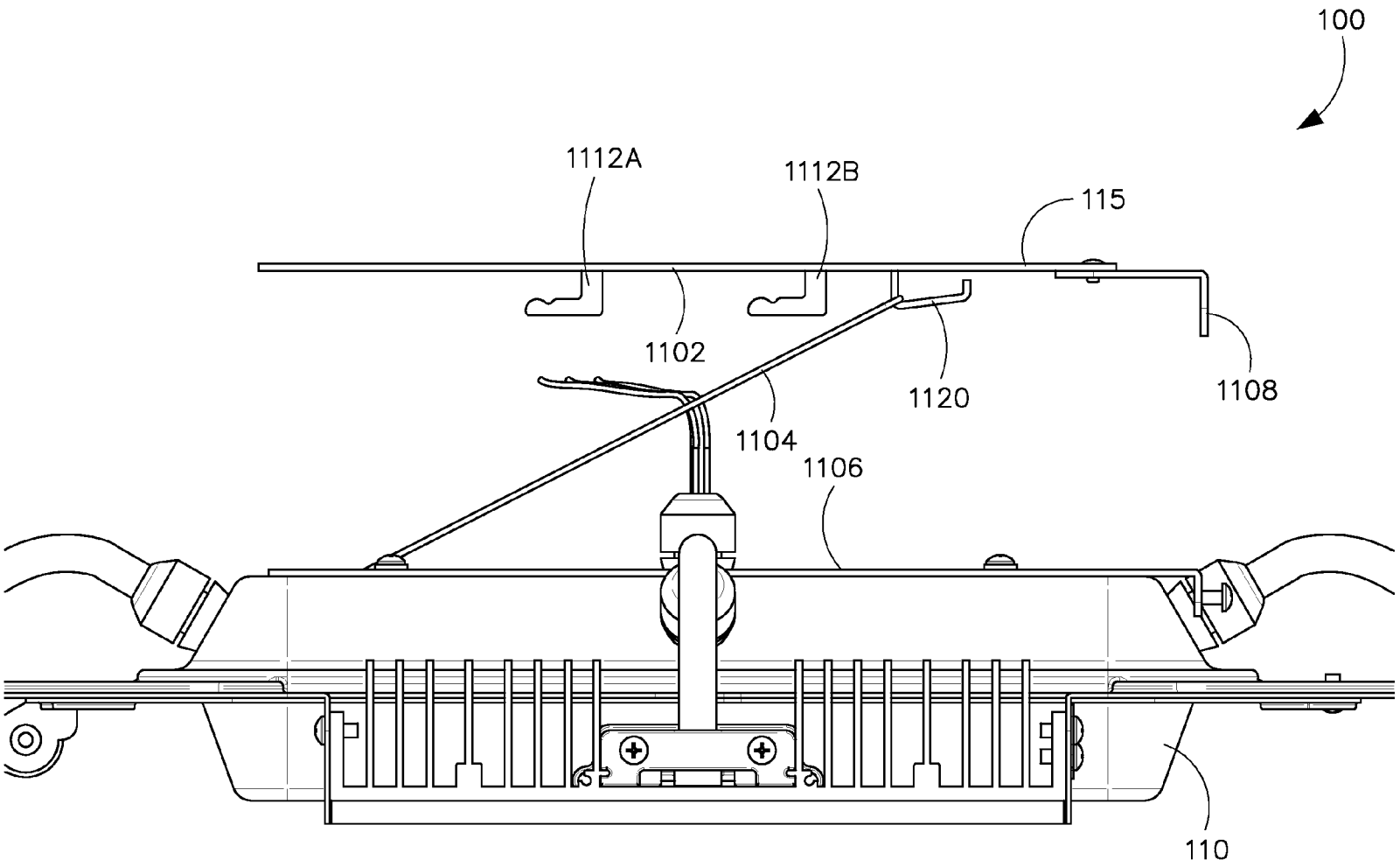
FIG. 8 is a side view of a light fixture and snap and lock hinge mount in an install position according to an example embodiment.

FIG. 8 is a side view of the light fixture 100 and the snap and lock hinge mount 115 in an install position. In FIG. 8, a support wire hook 1120 of the top plate 1102 is illustrated.

The wire support hanger 1104 is hung on the support wire hook 1120. The wire support hanger 1104 is also mounted adjacent to or against the bottom plate 1106, creating a pivot for the support wire support hanger 1104 to swing. When the wire support hanger 1104 is hung on the support wire hook 1120, the bottom plate 1106 hangs from the top plate 1102.

Figure 9:
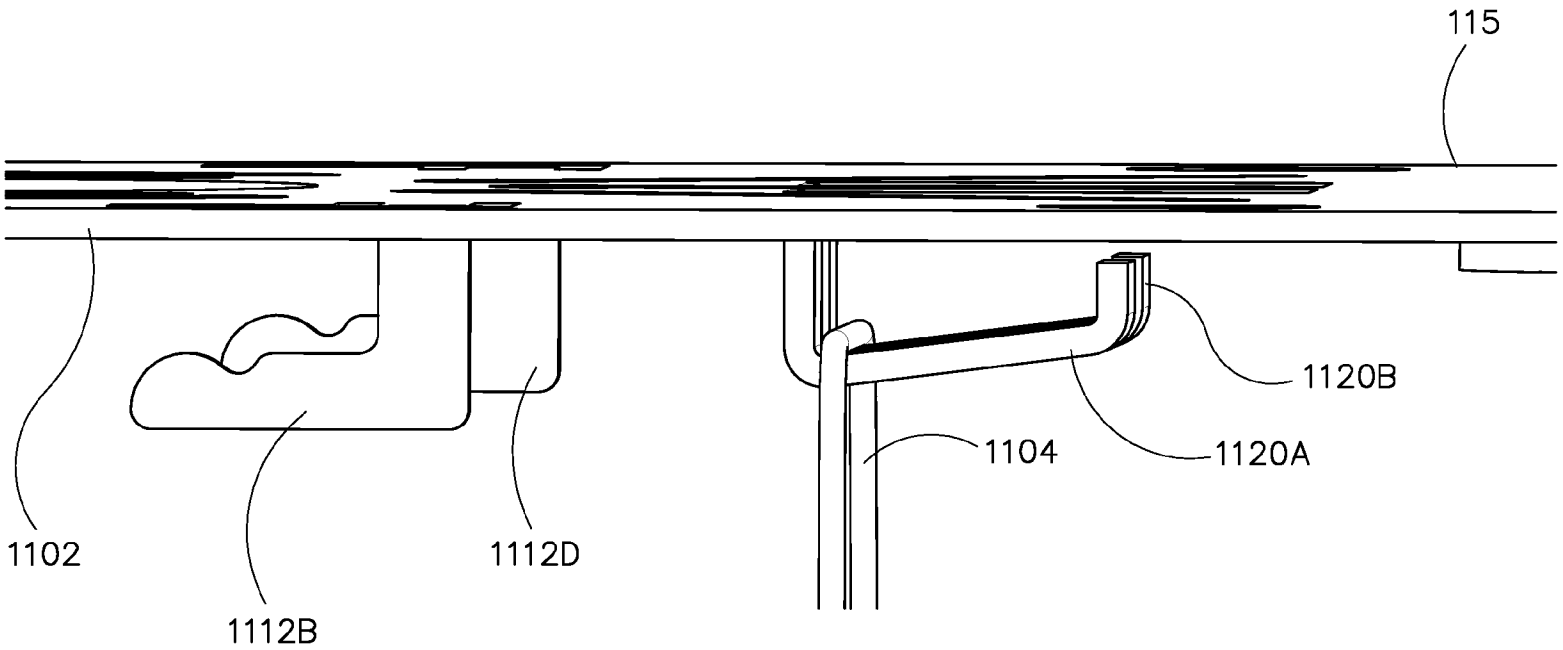
FIG. 9 is a side view of a snap foot and support wire hook of a snap and lock hinge mount according to an example embodiment.

FIG. 9 is a side view of the snap foot 1112B and the support wire hook 1120 of the snap and lock hinge mount 115. As illustrated in FIG. 9, the support wire hook 1120 includes two support wire hooks, 1120A and 1120B. Further, the snap foot 1112D proximate to the other side of the top plate 1102 is illustrated in FIG. 9. In certain example embodiments, the snap feet 112 are replaced or supplemented by other coupling mechanisms such as, but not limited to, clips, hooks, latches, etc.

Figure 10:
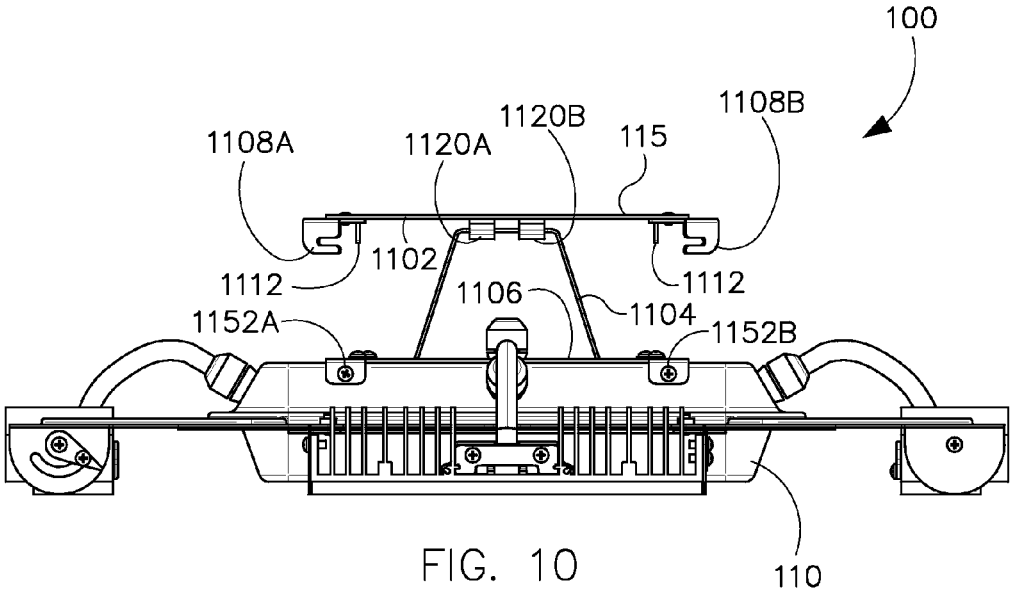
FIG. 10 is another side view of a light fixture and snap and lock hinge mount in an install position according to an example embodiment.

FIG. 10 is another side view of the light fixture 100 and snap and lock hinge mount 115 in the install position. It is noted that, in the install position, the bottom plate 1106 and the light fixture 100, hanging via the wire support hanger 1104 from the support wire hooks 1120A and 1120B, may be swung (i.e., moved) within a certain range of motion to permit access for electrical wiring connections to the light fixture 100.

Figure 11:
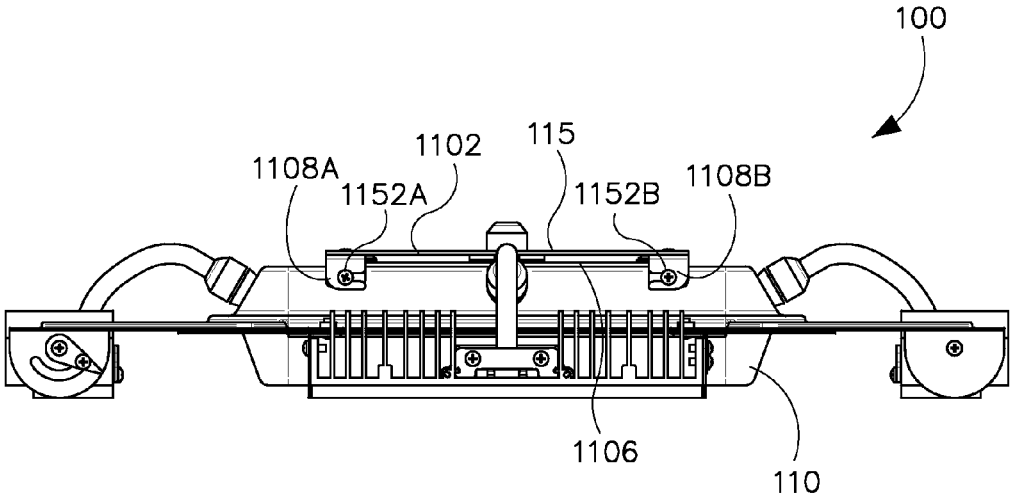
FIG. 11 is another side view of a light fixture and snap and lock hinge mount in a mounted position according to an example embodiment.

FIG. 11 is another side view of the light fixture 100 and snap and lock hinge mount 115 in the mount position. In the mount position illustrated in FIG. 11, the top plate 1102 and bottom plate 1106 are bought together into contact or near-contact. Further, the lock arms 1108A and 1108B have been rotated into position over the screws 1152A and 1152B, respectively. Once the screws 1152A and 1152B have been tightened, the lock arms 1108A and 1108B are unable to pivot and are locked into position. Thus, the snap and lock hinge mount 115 is fixed in the mounted position.

Figure 12:
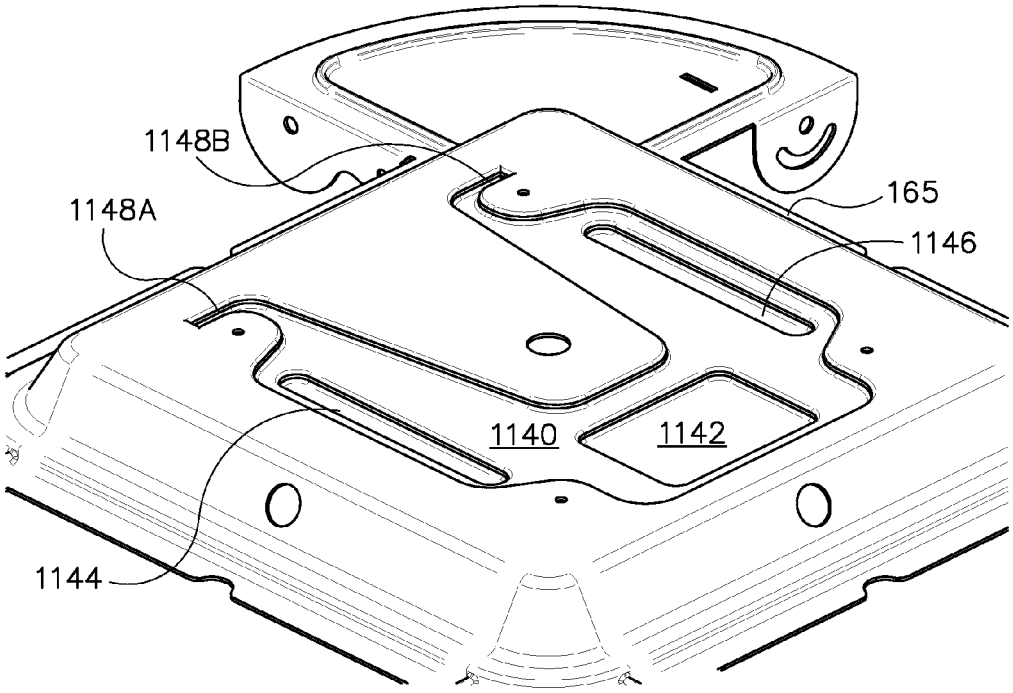
FIG. 12 is a perspective view of a top cover of a light fixture for assembly with a snap and lock hinge mount according to an example embodiment.

FIG. 12 is a perspective view of a top cover 165 of the light fixture housing 110. As illustrated in FIG. 12, several embossed recesses are formed into the top cover 165. According to certain embodiments, before the bottom plate 1106 is mounted to the light fixture housing 110, the wire support hanger 1104 may be placed into a first embossed recess 1140. Ends of the wire support hanger 1104 are placed into end channels 1148A and 1148B. After placing the wire support hanger 1104 into the first embossed recess 1140, the bottom plate 1106 may be mounted to the top cover 165 of the light fixture housing 110, securing the wire support hanger 1104 between the top cover 165 and the bottom plate 1106. The embossed recesses 1144 and 1146 are recessed deeper than the embossed recess 1140, and permit spacing for the snap feet 1112, as described in further detail below. A further embossed recess 1142 is recessed deeper than the embossed recess 1140, and permits spacing for the wire support hooks 1120 when the snap and lock hinge mount 115 is in the mounted position.

Figure 13:
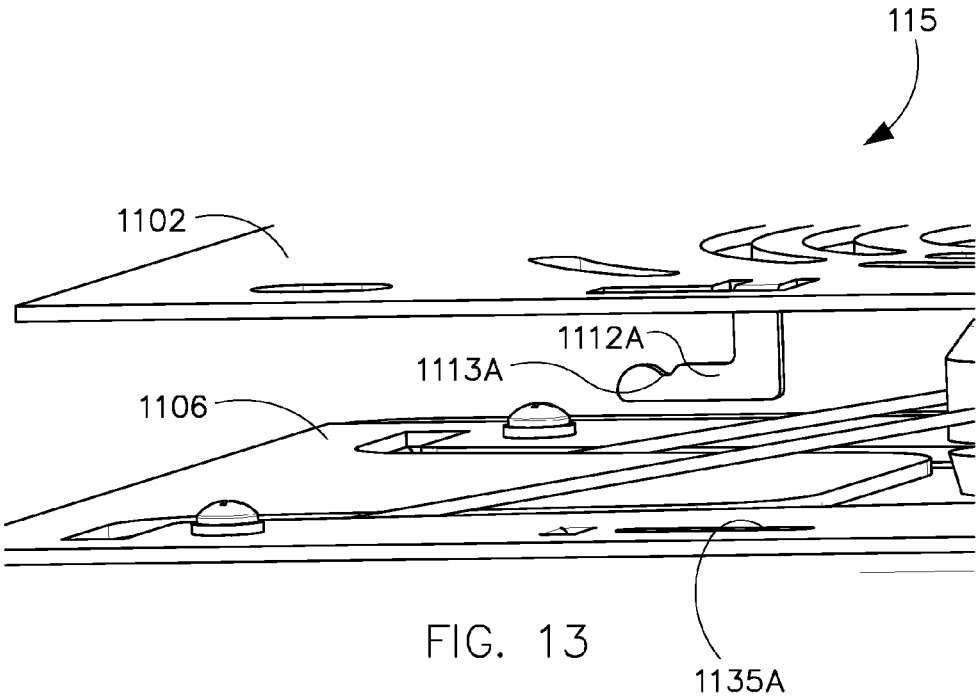
FIG. 13 is a view of a snap and lock hinge mount in an install position according to an example embodiment.

FIG. 13 is a view of the snap and lock hinge mount 115 in an install position. As the top plate 1102 and bottom plate 1106 are brought together into contact or near-contact, the first snap foot 1112A is positioned to pass through the through-hole 1135A. Similarly, other snap feet (e.g., 1112B, 1112D, etc.) of the top plate 1102 are positioned to pass through corresponding through-holes in the bottom plate 1106. In FIG. 13, a depression 1113A of the first snap foot 1112A is illustrated. The depression 1113A is snapped into place when the snap and lock hinge mount 115 is moved into the mounted position as described below with reference to FIGS. 14-16.

Figure 14:
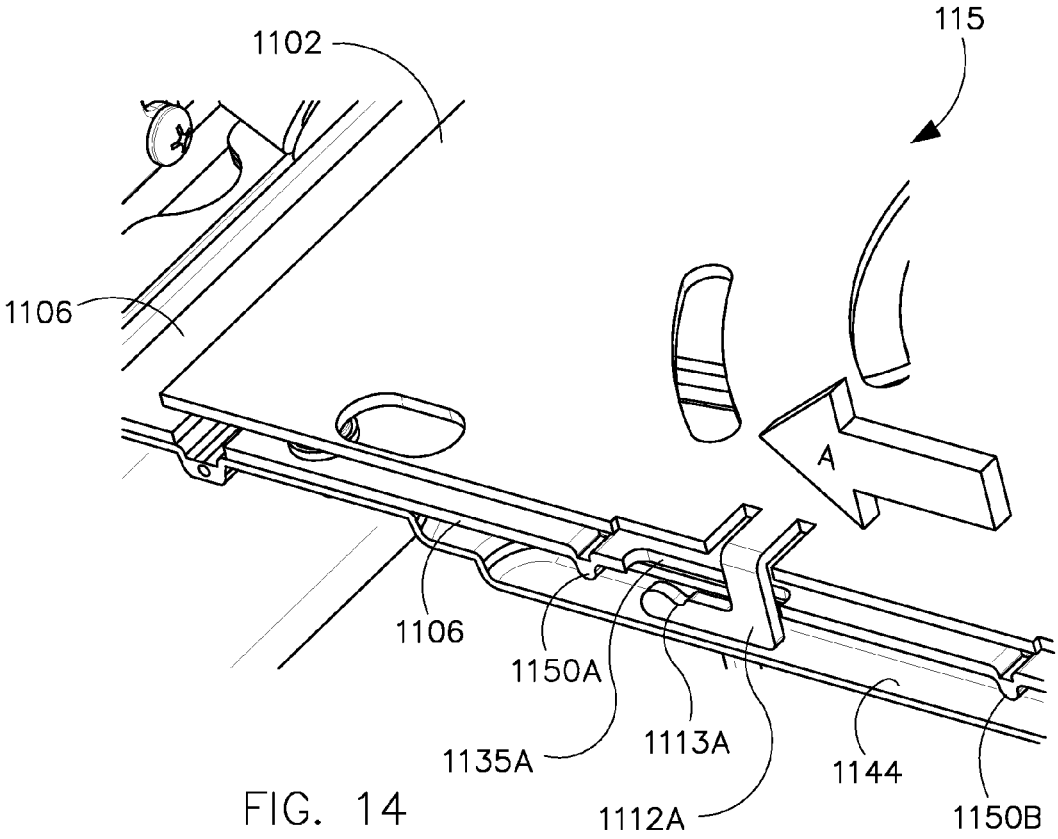
FIG. 14 is a view of a snap and lock hinge mount in a seated position before snapping and locking the mount according to an example embodiment.

FIG. 14 is a view of the snap and lock hinge mount 115 before snapping the mount in a mounted position. In FIG. 14, before snapping the snap and lock hinge mount 115 into the mounted (and locked) position, the top plate 1102 and bottom plate 1106 are brought together into contact or near-contact. The first snap foot 1112A passes through the through-hole 1135A and falls into the embossed recess 1144. In FIG. 14, the first foot rest 1150A of the bottom plate 1106 is illustrated. From the position illustrated in FIG. 14, the top plate 1102 is slid in the direction "A", and the first snap foot 1112A can be slid so that the depression 1113A is seated over the first foot rest 1150A.

Figure 15:
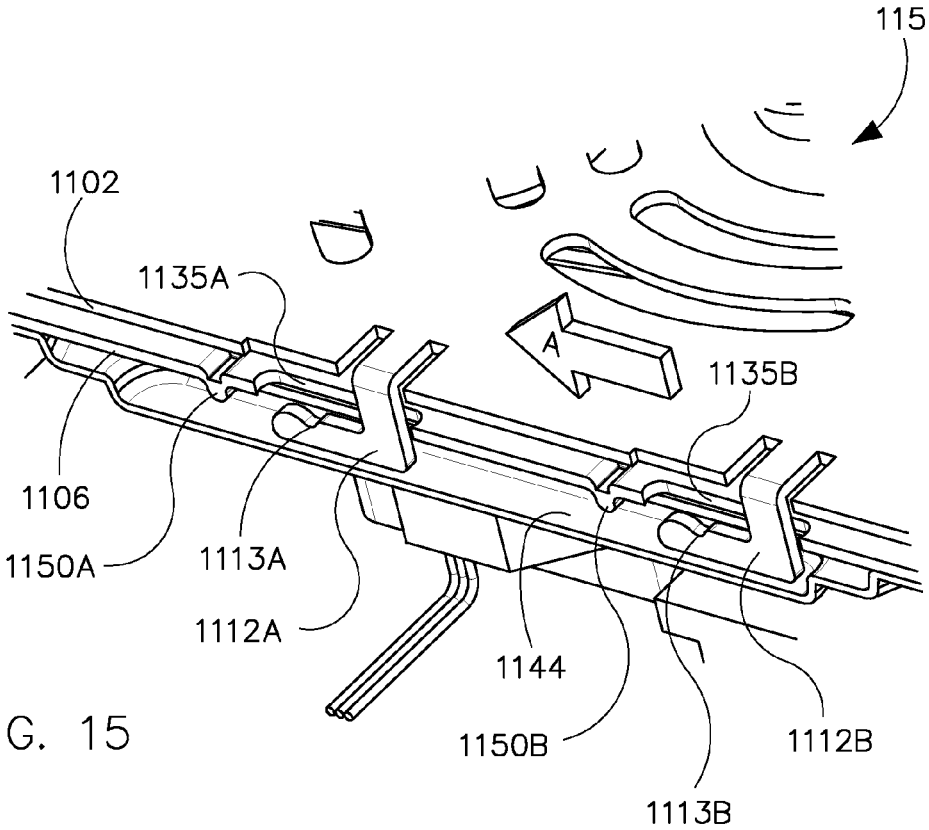
FIG. 15 is another view of a snap and lock hinge mount in a seated position before snapping and locking the mount, according to an example embodiment.

FIG. 15 is another view of the snap and lock hinge mount 115 before snapping the mount in the mounted position. In FIG. 15, before snapping the snap and lock hinge mount 115 into the mounted (and/or locked) position, the top plate 1102 and bottom plate 1106 are brought together into contact or near-contact. The first snap foot 1112A passes through the through-hole 1135A and falls into the embossed recess 1144, and the second snap foot 1112B passes through the through-hole 1135B and falls into the embossed recess 1144. In FIG. 15, the first foot rest 1150A and the second foot rest 1150B of the bottom plate 1106 is illustrated. From the position illustrated in FIG. 15, the top plate 1102 can be slid in the direction "A", and the first snap foot 1112A and the second snap foot 1112B are slid so that the depressions 1113A and 1113B are seated over the first and second foot rests 1150A and 1150B, respectively.

Figure 16:
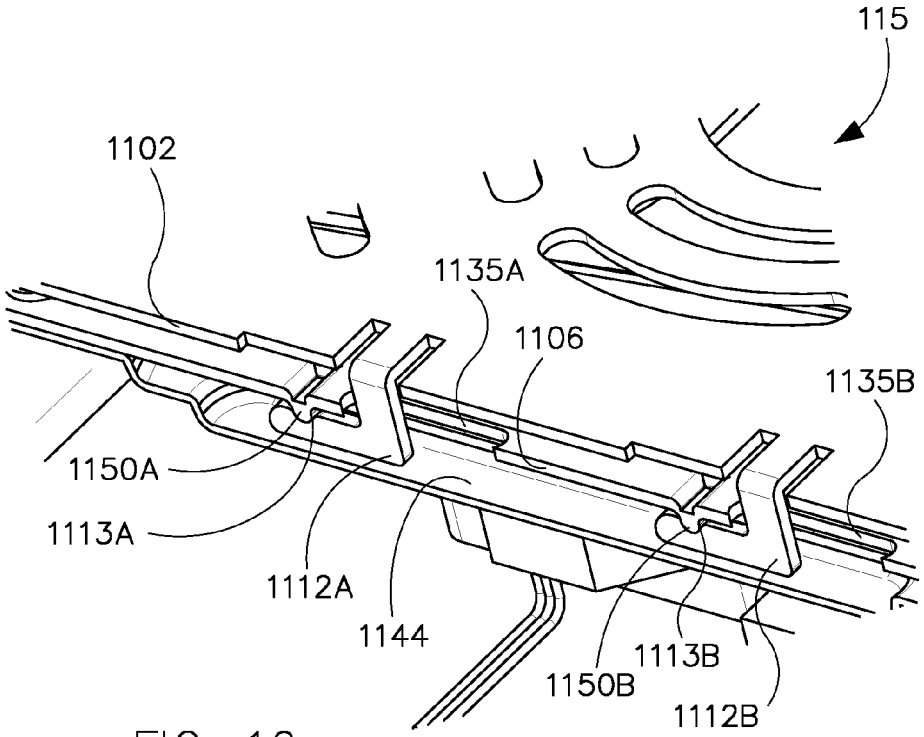
FIG. 16 is a view of a snap and lock hinge mount in a seated position after snapping the mount, according to an example embodiment.

FIG. 16 is a view of the snap and lock hinge mount 115 in a mounted position after snapping the mount in the seated position. As illustrated in FIG. 16, the top plate 1102 has been slid in the direction "A", and the first snap foot 1112A and the second snap foot 1112B are slid such that the depressions 1113A and 1113B are seated over the first and second foot rests 1150A and 1150B, respectively. It is noted that, in the embodiments described herein, the snap and lock hinge mount 115 includes a through-hole 1135 and foot rest 1150 for each snap foot 1112 of the top plate 1102. It is further noted that, as the first snap foot 1112A and the second snap foot 1112B are slid in the direction "A", the ends of the feet 1112A and 1112B make noticeable contact with the foot rests 1150A and 1150B and offer a certain amount of resistance. As the feet 1112A and 1112B are further slid in the direction "A" such that the depressions 1113A and 1113B are seated over the first and second foot rests 1150A and 1150B, respectively, the snap and lock hinge mount 115 "snaps" into the mounted position. In example embodiments, the "snap" may be detected in an audible and/or tactile sense.

Figure 17:
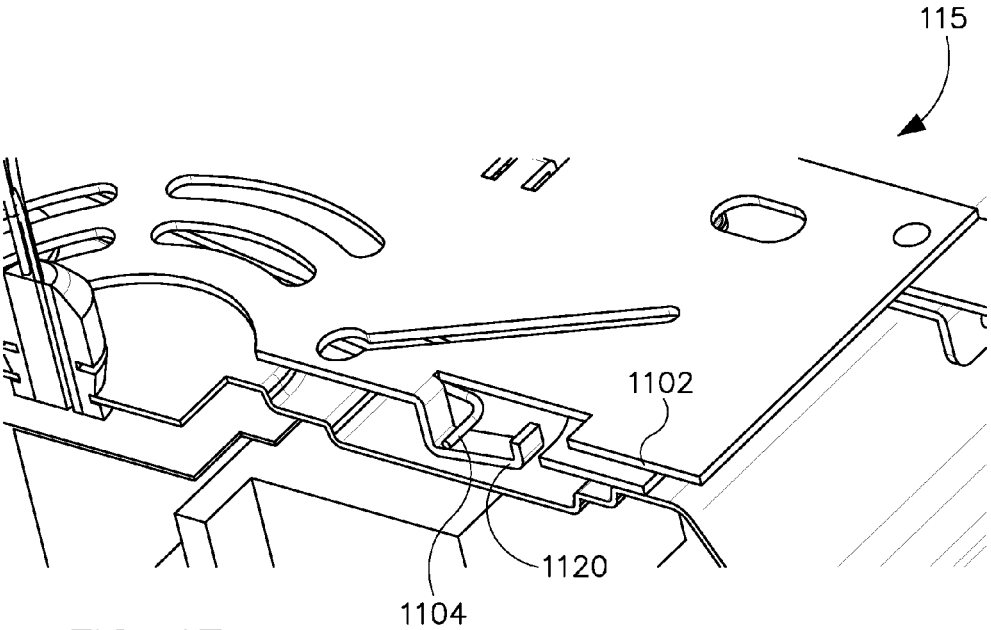
FIG. 17 is a cutaway side view of a wire support hanger and wire hook of a snap and lock hinge mount before snapping the mount into a seated position, according to an example embodiment.

FIG. 17 is a cutaway side view of the wire support hanger 1104 and the wire hook 1120 of the snap and lock hinge mount 115, before snapping the mount 115 into the mounted position. From the position illustrated in FIG. 17, the top plate 1102 can be slid in the direction "A", and the wire support hanger 1104 slides along the wire hook 1120 from the position illustrated in FIG. 17 to the position illustrated in FIG. 18.

Figure 18:
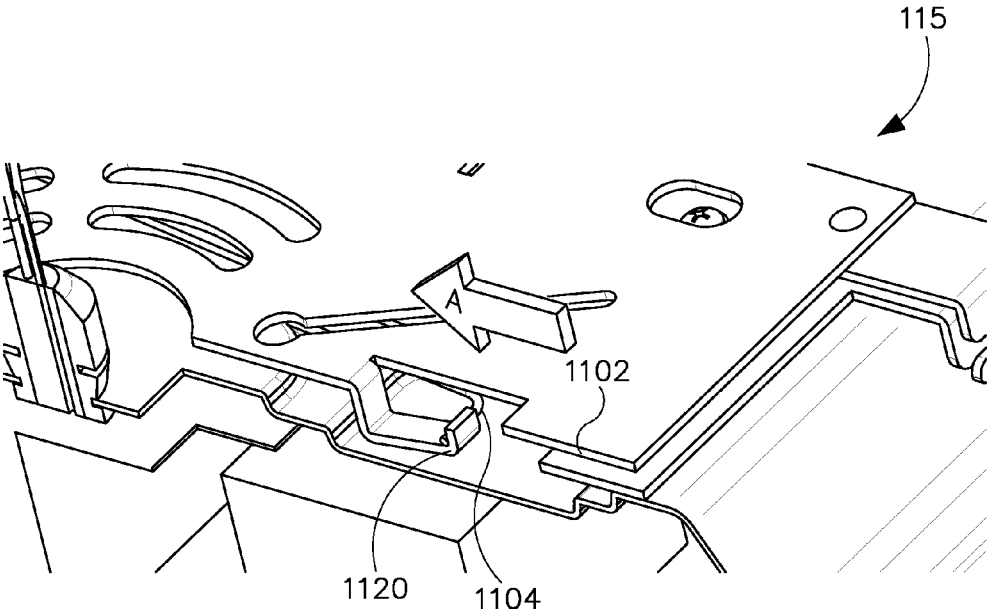
FIG. 18 is a cutaway side view of a wire support hanger wire and wire hook of a snap and lock hinge mount after snapping the mount into a seated position, according to an example embodiment.

FIG. 18 is a cutaway side view of the wire support hanger 1104 and the wire hook 1120 of the snap and lock hinge mount 115, after snapping the mount 115 into the mounted position. As illustrated in FIG. 18, the top plate 1102 has been slid in the direction "A", and the wire support hanger 1104 has moved along the wire hook 1120 from the position illustrated n FIG. 17 to the position illustrated in FIG. 18.

Figure 19:
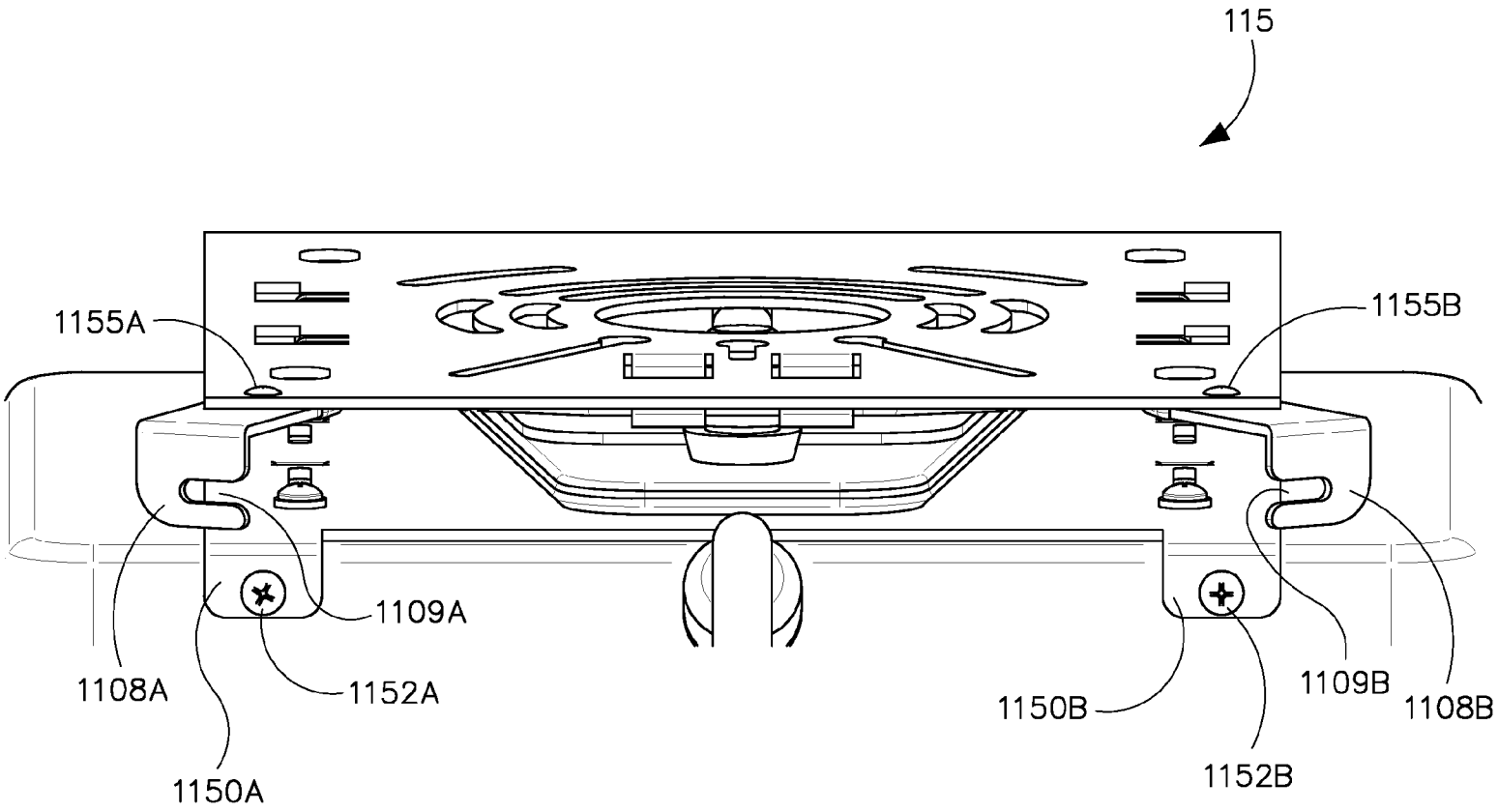
FIG. 19 is a perspective side view of a snap and lock hinge mount before locking the mount, according to an example embodiment.

FIG. 19 is a perspective side view of the snap and lock hinge mount 115 according to an example embodiment of the disclosure, before locking the mount 115. In FIG. 19, the top plate 1102 and the bottom plate 1106 are illustrated before being brought into near-contact, and the lock arms 1108A and 1108B are rotated outward so as not to touch the screws 1152A and 1152B. After the top plate 1102 and the bottom plate 1106 are brought into contact or near-contact and the top plate 1102 is slid into the seated position, as described above, the lock arms 1108A and 1108B may be pivoted at pivot points 1155A and 1155B, respectively. The lock arms 1108A and 1108B include eyelets 1109A and 1109B, respectively. After the top plate 1102 and the bottom plate 1106 are slid into the seated position, the lock arms 1108A and 1108B may be rotated at pivot points 1155A and 1155B over the screws 1152A and 1152B, respectively, and secured into a locked position by tightening the screws 1152A and 1152B. The screws 1152A and 1152B, in various embodiments, may be secured with a washer or other means to prevent the screws 1152A and 1152B from being removed from the mount 115.

Figure 20:
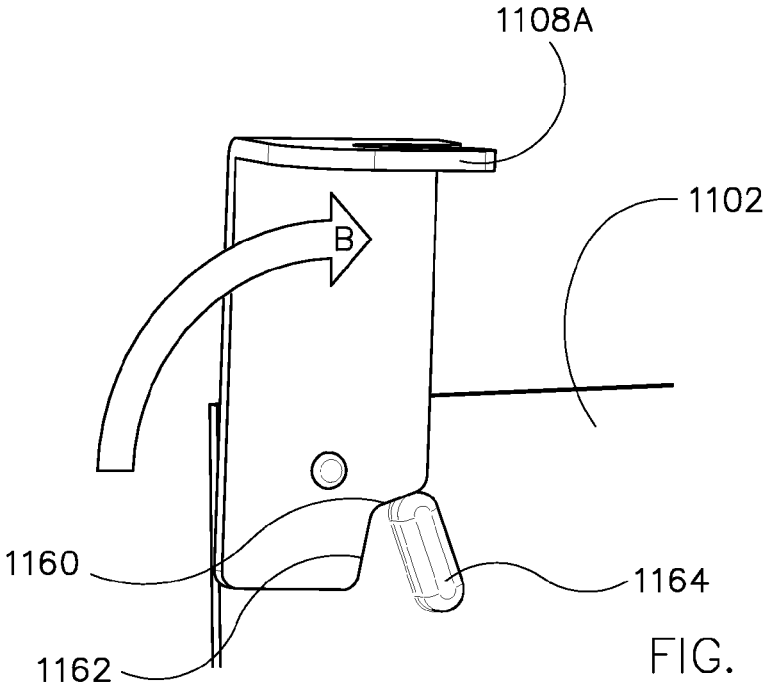
FIG. 20 is a bottom view of a lock arm of a lock hinge mount after locking the mount with the lock arm, according to an example embodiment.

FIG. 20 is a bottom view of the lock arm 1108A after locking the snap and lock hinge mount 115. In FIG. 20, the lock arm stop 1164 is illustrated. The lock arm stop 1164, in the position illustrated in FIG. 20, prevents the lock arm 1108A from moving further in the direction "B", based on contact between the edge 1160 and the stop 1164. It is noted that the position of the lock arm 1108A illustrated in FIG. 20 corresponds to the position of the lock arm 1108A illustrated in FIG. 11, for example.

Figure 21:
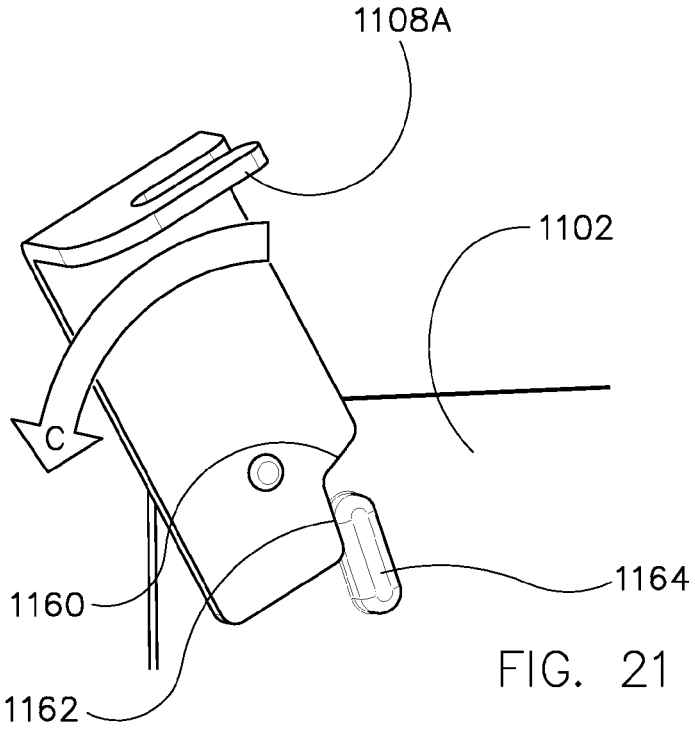
FIG. 21 is a bottom view of a lock arm of a lock hinge mount before locking the mount with the lock arm, according to an example embodiment.

FIG. 21 is a bottom view of the lock arm 1108A before locking the snap and lock hinge mount 115. In the position illustrated in FIG. 21, the lock arm stop 1164, prevents the lock arm 1108A from moving further in the direction "C", based on contact between the edge 1162 and the stop 1164. It is noted that the position of the lock arm 1108A illustrated in FIG. 21 corresponds to the position of the lock arm 1108A illustrated in FIG. 19, for example.

In certain example embodiments, the bottom plate 1106 of the snap and lock hinge mount 115 is one and the same as the top surface 111 of the central housing 110.

Although each example embodiment has been described in detail, it is to be construed that any features and modifications that are applicable to one embodiment are also applicable to the other embodiments. Furthermore, although the disclosure has been described with reference to specific embodiments, these descriptions are not meant to be construed in a limiting sense. Various modifications of the disclosed embodiments, as well as alternative embodiments of the disclosure will become apparent to persons of ordinary skill in the art upon reference to the description of the example embodiments. It should be appreciated by those of ordinary skill in the art that the conception and the specific embodiments disclosed may be readily utilized as a basis for modifying or designing other structures or methods for carrying out the same purposes of the disclosure. It should also be realized by those of ordinary skill in the art that such equivalent constructions do not depart from the spirit and scope of the disclosure as set forth in the appended claims. It is therefore, contemplated that the claims will cover any such modifications or embodiments that fall within the scope of the disclosure.

What is claimed is:

1. A mounting assembly for a light fixture, comprising:

a top plate comprising a first mating mechanism and a pair of lock arms that are pivotally coupled to the top plate, wherein each lock arm comprises: a first planar portion that is coupled to the top plate and is substantially parallel to the top plate, and a second planar portion that extends from an edge of the first planar portion towards a direction of a bottom plate and such that the second planar portion is substantially perpendicular to the first planar portion, wherein the second planar portion of each lock arm comprises an eyelet;

a support hanger comprising a first end and a second end, the first end rotationally coupled to the top plate; and the bottom plate comprising a second mating mechanism corresponding to the first mating mechanism, wherein the second end of the support hanger is rotationally coupled to the bottom plate, wherein the bottom plate comprises a pair of substantially L-shaped flanges extending out from one edge of the bottom plate, wherein each substantially L-shaped flange comprises: a first leg that is substantially parallel to the bottom plate, and a second leg that extends downwards towards a light fixture from an edge of the first leg, wherein the second leg of each substantially L-shaped flange comprises an aperture that has a fastener disposed therethrough;

wherein the mounting assembly is foldable into a folded position and extendable into an extended position, wherein in the folded position, the bottom plate, the support hanger, and the top plate are substantially parallel, and wherein the bottom plate is coupled to the top plate via the first and second mating mechanisms, the bottom plate being a first distance from the top plate; and wherein in the extended position, the first mating mechanism is decoupled from the second mating mechanism, the bottom plate being a second distance from the top plate, the second distance being greater than the first distance, and wherein the bottom plate is supported by the top plate via the support hanger.

2. The mounting assembly of claim 1, wherein the first mating mechanism comprises a hook, and the second mating mechanism comprises a hook receptacle.

3. The mounting assembly of claim 2, wherein the hook slides into the hook receptacle to hold the mounting assembly in the folded position.

4. The mounting assembly of claim 1, wherein the bottom plate is configured to be coupled to the light fixture, wherein the top plate is configured to support the light fixture via the support hanger and the bottom plate when the mounting assembly is in the extended position.

5. The mounting assembly of claim 4, wherein the top plate is configured to support the light fixture via the bottom plate and the first and second mating mechanism when the mounting assembly is in the folded position.

6. The mounting assembly of claim 1, wherein the bottom plate is a top surface of a housing of the light fixture.

7. The mounting assembly of claim 1, wherein, in the folded position, each lock arm is pivoted towards its corresponding substantially L-shaped flange on the bottom plate such that: (a) the eyelet in the lock arm's second planar portion engages the fastener that passes through the aperture in the second portion of the corresponding substantially L-shaped flange, and (b) the fastener is tightened to lock the top plate to the bottom plate in the folded position.

8. The mounting assembly of claim 1, wherein the top plate further comprises a stop mechanism disposed at a bottom surface of the top plate, and wherein the stop mechanism is disposed adjacent an edge of the lock arm such that the stop mechanism engages the lock arm to control a rotation of the lock arm between an open position and a lock position.

9. The mounting assembly of claim 1, wherein the top plate further comprises a stop mechanism that is configured to limit a rotation of the lock arm between a first position and a second position.

10. A luminaire comprising:

a light fixture comprising a housing that is configured to house one or more electrical components associated with the operation of the light fixture and one or more rotatable light modules coupled to the housing;

a mounting assembly coupled to the housing, wherein the mounting assembly comprises:

a top plate comprising a first mating mechanism and a pair of lock arms that are pivotally coupled to the top plate, wherein each lock arm comprises: a first planar portion that is coupled to the top plate and is substantially parallel to the top plate, and a second planar portion that extends from an edge of the first planar portion towards a direction of a bottom plate and such that the second planar portion is substantially perpendicular to the first planar portion, wherein the second planar portion of each lock arm comprises an eyelet;

a support hanger comprising a first end and a second end, the first end rotationally coupled to the top plate; and the bottom plate that is coupled to a top surface of the housing and comprising a second mating mechanism corresponding to the first mating mechanism, wherein the second end of the support hanger is rotationally coupled to the bottom plate, wherein the bottom plate comprises a pair of substantially L-shaped flanges extending out from one edge of the bottom plate, wherein each substantially L-shaped flange comprises: a first leg that is substantially parallel to the bottom plate, and a second leg that extends downwards towards a light fixture from an edge of the first leg, wherein the second leg of each substantially L-shaped flange comprises an aperture that has a fastener disposed therethrough, wherein the mounting assembly is foldable into a folded position and extendable into an extended position, wherein in the folded position, the top surface of the housing, the bottom plate, the support hanger, and the top plate are substantially parallel, and wherein the bottom plate is coupled to the top plate via the first and second mating mechanisms, the bottom plate being a first distance from the top plate; and wherein in the extended position, the first mating mechanism is decoupled from the second mating mechanism, the bottom plate being a second distance from the top plate, the second distance being greater than the first distance, and wherein the bottom plate and the light fixture are supported by the top plate via the support hanger.

11. The luminaire of claim 10, wherein the first mating mechanism comprises a hook, and the second mating mechanism comprises a hook receptacle.

12. The luminaire of claim 11, wherein the hook comprises a notch and the bottom plate comprises a protrusion disposed adjacent the hook receptacle.

13. The luminaire of claim 12, wherein the hook slides into the hook receptacle such that the notch in the hook engages the protrusion in the bottom plate to hold the mounting assembly in the folded position.

14. The luminaire of claim 10, wherein, in the folded position, each lock arm is pivoted towards its corresponding substantially L-shaped flange on the bottom plate such that: (a) the eyelet of the lock arm's second planar portion engages the fastener that passes through the aperture in the second portion of the corresponding substantially L-shaped flange, and (b) the fastener is tightened to lock the top plate to the bottom plate in the folded position.

15. The luminaire of claim 10, wherein the top plate comprises a pair of support wire hooks that are disposed on a bottom surface of the top plate, and wherein the pair of support wire hooks are configured to receive and rotationally couple the first end of the support hanger to the top plate.

16. The luminaire of claim 10, wherein the top plate further comprises a stop mechanism for each lock arm disposed at a bottom surface of the top plate, and wherein the stop mechanism is disposed adjacent an edge of each lock arm such that the stop mechanism engages the lock arm to control a rotation of the lock arm between an open position and a lock position.

* * * * *